US005355957A

United States Patent [19]

Burleson et al.

[11] Patent Number: 5,355,957

[45] Date of Patent: Oct. 18, 1994

[54] COMBINED PRESSURE TESTING AND SELECTIVE FIRED PERFORATING SYSTEMS

[75] Inventors: John D. Burleson; Justin L. Mason, both of Denton; Flint R. George, Flower Mound, all of Tex.

[73] Assignee: Halliburton Company, Houston, Tex.

[21] Appl. No.: 134,125

[22] Filed: Oct. 8, 1993

Related U.S. Application Data

[63] Continuation-in-part of Ser. No. 937,601, Aug. 28, 1992, Pat. No. 5,287,924.

[51] Int. Cl.[5] ..... E21B 29/02

[52] U.S. Cl. ..... 166/297; 166/55; 166/63

[58] Field of Search ..... 166/55, 55.1, 51, 296, 166/297, 299, 63

[56] References Cited

U.S. PATENT DOCUMENTS

| | | | |
|---|---|---|---|
| 3,717,095 | 2/1973 | Vann | 102/21.6 |
| 4,496,010 | 1/1985 | Chapman, III | 175/4.55 |
| 4,612,992 | 9/1986 | Vann et al. | 166/297 |
| 4,823,875 | 4/1989 | Hill | 166/280 |
| 4,901,802 | 2/1990 | George et al. | 166/297 X |
| 4,969,525 | 11/1990 | George et al. | 166/297 |
| 5,078,210 | 1/1992 | George | 166/55 |
| 5,103,912 | 4/1992 | Flint | 166/297 |
| 5,115,865 | 5/1992 | Carisella et al. | 166/297 |
| 5,161,616 | 11/1992 | Colla | 166/297 |
| 5,287,924 | 2/1994 | Burleson et al. | 166/297 |

OTHER PUBLICATIONS

Exhibit A–Undated advertising brochure admitted to be prior art illustrating the Vann Systems Time Delayed Firing Head.

Exhibit B–Undated brochure admitted to be prior art illustrating a Vann Systems Differential Firing Head.

Exhibit C–Catalog pp. 22–37 from a Gearhart Company catalog. This Reference is Undated but is Admitted to be Prior Art.

*Primary Examiner*—Ramon S. Britts
*Assistant Examiner*—Frank S. Tsay
*Attorney, Agent, or Firm*—Tracy W. Druce; Lucian Wayne Beavers

[57] ABSTRACT

A system is provided for performing multiple operations on a well in response to multiple fluid pressure increases. The system includes first and second pressure actuated firing heads and a source of actuating fluid pressure for the firing heads. A first selective communication device is provided for isolating the second firing head from the source of actuating fluid pressure until after the first firing head has been actuated and for then communicating the second firing head with the source of actuating fluid pressure in response to actuation of the first firing head. This system is particularly adapted for allowing pressure testing of a well upon a first fluid pressure increase, followed by perforation of the well upon a second fluid pressure increase.

19 Claims, 5 Drawing Sheets

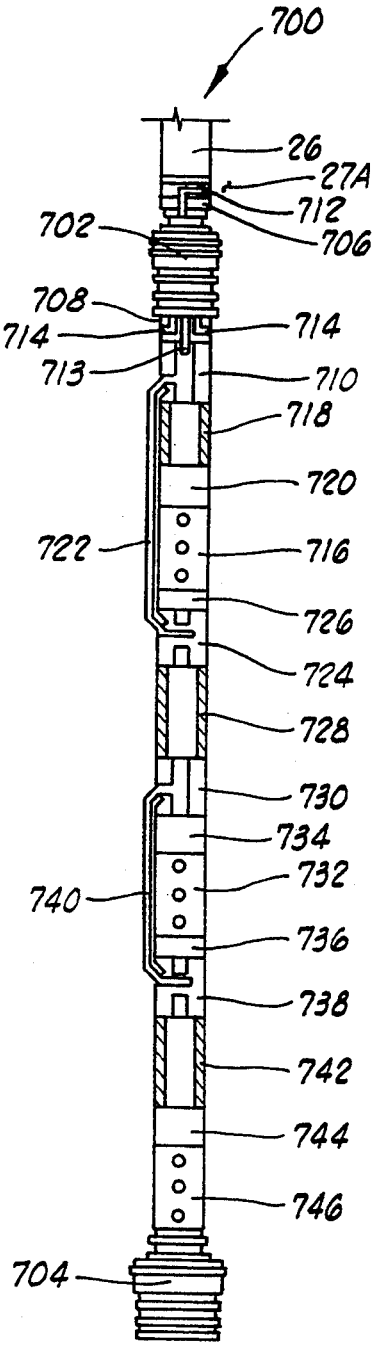
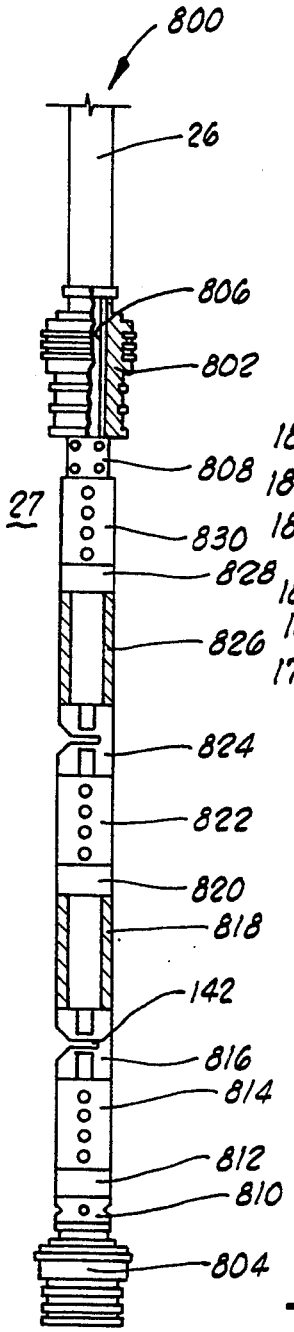
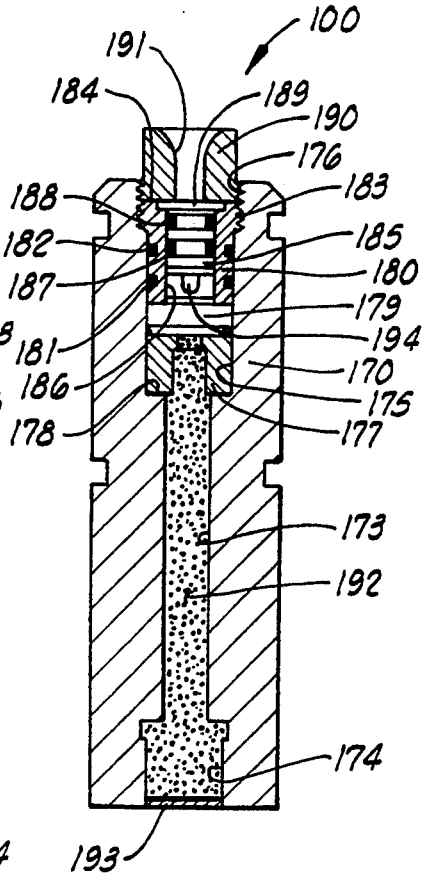
FIG. 9
FIG. 7 FIG. 8

COMBINED PRESSURE TESTING AND SELECTIVE FIRED PERFORATING SYSTEMS

CROSS-REFERENCE TO RELATED APPLICATIONS

The present application is a continuation-in-part of application Ser. No. 07/937,601 of Burleson et al., entitled TUBING CONVEYED SELECTIVE FIRED PERFORATING SYSTEMS, filed Aug. 28, 1992 now U.S. Pat. No. 5,287,924.

BACKGROUND OF THE INVENTION

1. Field of the Invention

The present invention relates to the field of well perforating.

2. Description of the Prior Art

During the completion of an oil or gas well, a length of casing is cemented in a borehole, and then one or more zones of the casing are perforated to communicate the bore of the casing with subsurface geological formations intersected by the borehole so that oil or gas from that subsurface formation may be produced by the well.

One well-known type of perforating system is a tubing conveyed perforating system wherein the perforating guns and related apparatus are carried by a tubing string made up of a plurality of threaded joints of tubing or pipe which are connected together and lowered into the well. These tubing conveyed completion systems may be run in combination with a drill stem test string so that the well can be perforated and tested in a single trip.

In some situations, it is desirable to be able to selectively perforate more than one zone of the well at different times. The prior art has typically addressed this need by the provision of multiple firing heads which are constructed to actuate at different operating pressures. With these systems, the selection of the appropriate firing head and gun to be fired is determined by the pressure which is applied to the tubing string or the well annulus to actuate the firing head. Systems of this type capable of firing several perforating guns independently during one trip into the well can be constructed utilizing the Time Delayed Firing Head available from Vann Systems of Carrollton, Tex. The Vann Time Delayed Firing Head utilizes a set of shear pins the number of which can be selected to determine the actuating pressure of each firing head.

SUMMARY OF THE INVENTION

The present invention provides a tubing conveyed selective fired perforating system for selectively perforating multiple zones of a well during a single trip into the well.

The system includes a tubing string carrying at least a first and a second perforating gun. At least a first and a second pressure actuated firing head are associated with the first and second perforating guns, respectively.

A source of actuating fluid pressure for the firing heads is provided. The source is preferably either the tubing bore of the tubing string or the well annulus surrounding the tubing string.

A first selective communication means is provided for isolating the second firing head from the source of actuating fluid pressure until after the first perforating gun has been fired, and for then communicating the second firing head with the source of actuating fluid pressure in response to firing of the first perforating gun.

Additional selective communication means can be provided to allow for firing of additional perforating guns selectively in sequence.

The selective communication means preferably is a select fire sub including a housing having a first chamber defined therein. The first chamber is communicated with the second firing head. A supply passage is communicated with the source of actuating fluid pressure and extends into the housing. The supply passage is initially isolated from the first chamber. An explosive means is contained in a second chamber of the housing for perforating a portion of the housing and thereby communicating the supply passage with the first chamber. An actuating means fires the explosive means of the select fire sub in response to firing of the first perforating gun.

In another aspect of the invention, first and second pressure actuated firing heads separated by a selective communication means may be utilized with a single perforating gun so as to allow another pressure responsive operation to be conducted on the well prior to firing of the perforating gun. For example, it may be desired to first pressure test the well, and then to subsequently operate the perforating gun. Thus, when the well is pressure tested, the first pressure responsive firing head will actuate the selective communication means which will then place a second firing head in position to subsequently fire the perforating gun the next time pressure is increased to an appropriate level.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 7 is an elevation schematic view of a fifth version of the tubing conveyed selective fired perforating system of the present invention. The system of FIG. 7 carries both a packer and a bridge plug and carries a flow test sub so that the various zones which are perforated may be flow tested after perforation. The system of FIG. 7 is constructed to be actuated by fluid pressure conveyed down the well annulus surrounding the tubing string and then crossed over through the upper packer to an external control fluid conduit communicating the series of select fire subs. The system of FIG. 7 is constructed to selectively fire the series of perforating guns in sequence from the top down.

FIG. 8 is an elevation schematic view of a sixth version of the tubing conveyed selective fired perforating system of the present invention. The system of FIG. 8 also carries both a retrievable packer and a retrievable bridge plug. It is constructed so that actuating fluid pressure is conveyed down the tubing string and then crossed over into the well annulus surrounding the perforating guns and select fire subs. The series of perforating guns and select fire subs are arranged so that the perforating guns are selectively fired sequentially from the bottom up. Due to the presence of both a packer and bridge plug which allows isolation of the perforated zone, the zone may then be flow tested after it is perforated.

FIG. 9 is an enlarged sectioned view of the gun delay/isolation device used in the isolation sub of FIG. 2.

DESCRIPTION OF THE PREFERRED EMBODIMENTS

Figure 1:
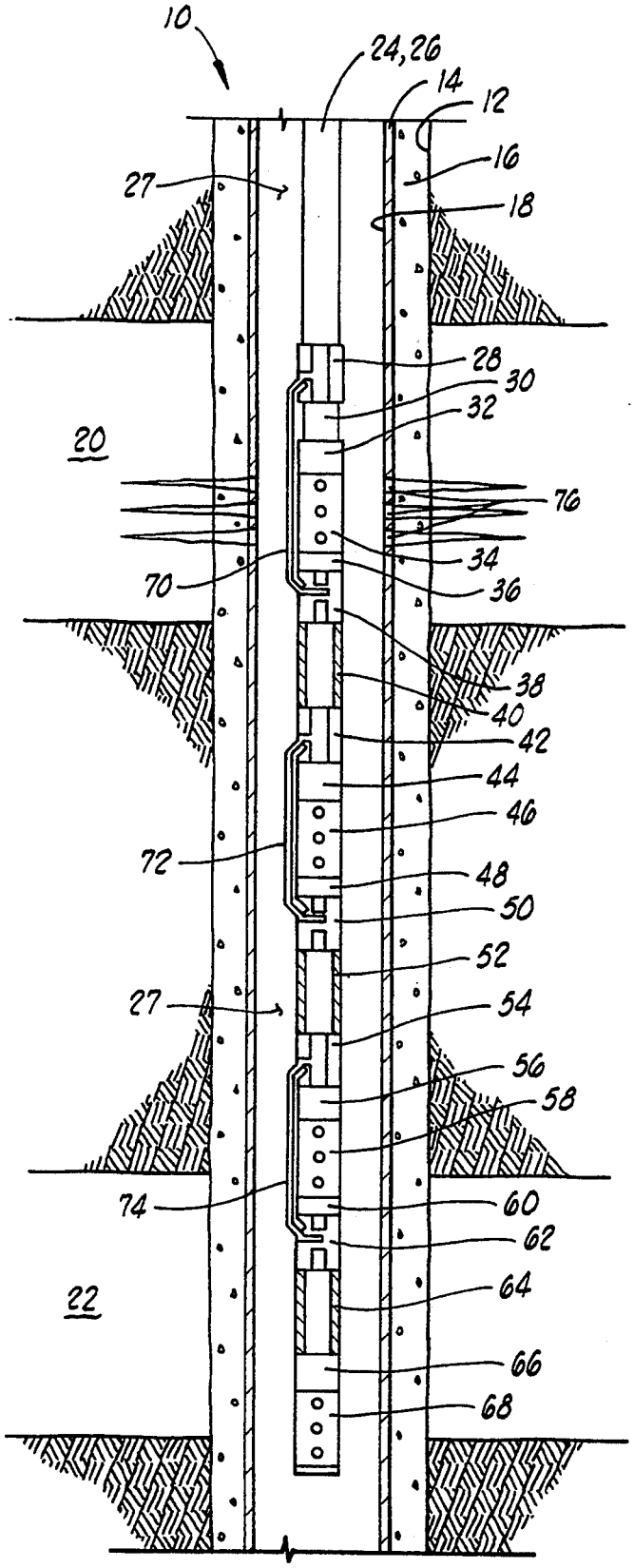
FIG. 1 is an elevation schematic view of a first embodiment of the tubing conveyed selective fired perforating system of the present invention shown in place in a well which intersects a plurality of subsurface geological formations which are to be perforated. The system of FIG. 1 is constructed to operate without a packer and to fire the plurality of perforating guns selectively in sequence from the top down. The system of FIG. 1 is arranged to be actuated by fluid pressure conveyed down the tubing string and then communicated through external control fluid conduits to the series of select fire subs.

Turning now to the drawings, and particularly to FIG. 1, a well is shown and generally designated by the numeral 10. The well 10 is formed by drilling a borehole 12 into the ground and then placing a casing 14 within the borehole 12 and cementing the casing in place with cement 16. The casing 14 has a casing bore 18. The borehole 12 intersects one or more subsurface geological formations such as 20 and 22 which are to be perforated for testing and/or production of the well from those zones.

A perforating string 24 is shown in place in the well 10. The perforating string 24 of the present invention may also be referred to as a tubing conveyed selective fired perforating system 24. A well annulus 27 is defined between the casing bore 18 and the perforating string 24.

The system 24 provides a means by which a plurality of perforating guns can be selectively fired so as to selectively perforate multiple zones of the well 10 such as the zones 20 and 22 illustrated in FIG. 1.

The system 24 includes a tubing string 26 which carries on its lower end a string of tools which beginning from top to bottom include a tubing annulus crossover sub 28, a tubing spacer sub 30, a first pressure actuating firing head 32, a first perforating gun 34, a first isolation sub 36, a first select fire sub 38, a first air chamber 40, a first control line sub 42, a second pressure actuated firing head 44, a second perforating gun 46, a second isolation sub 48, a second select fire sub 50, a second air chamber 52, a second control line sub 54, a third pressure actuated firing head 56, a third perforating gun 58, a third isolation sub 60, a third select fire sub 62, a third air chamber 64, a fourth pressure actuated firing head 66, and a fourth perforating gun 68.

It will be understood that each of the perforating guns schematically illustrated in FIG. 1 may be made up of many individual gun segments connected together in series to provide the proper length of gun to perforate the zone in question.

The tubing annulus crossover sub 28 is communicated with the first select fire sub 38 by a first control fluid conduit portion 70. The conduit 70 may be $\frac{1}{4}''$ O.D. stainless steel tubing. The first control line sub 42 is communicated to the second select fire sub 50 by a second control fluid conduit portion 72. The second control line sub 54 is communicated to the third select fire sub 62 by a third control fluid conduit portion 74.

The system 24 is constructed for use without a packer and is arranged to fire the perforating guns 34, 46, 58 and 68 selectively in sequence from the top down. That is, the first gun to fire will be first gun 34. The next gun to fire will be second gun 46 and so forth.

To selectively perforate multiple zones such as zones 20 and 22 of the well 10 with the system 24 the procedure is carried out as follows. The system 24 is lowered into the casing bore 18 of well 10 until the first perforating gun 34 is located adjacent the first subsurface zone 20 which is to be perforated.

Actuating fluid pressure to actuate the firing heads associated with each of the perforating guns is provided through the bore of the tubing string 26 which may be generally described as a source 26 of actuating fluid pressure for the firing heads such as 32, 44, 56 and 66.

This actuating fluid pressure is communicated through the tubing annulus crossover sub 28 to both the first control fluid conduit portion 70 and through the tubing spacer sub 30 to the first pressure actuated firing head 32.

Figure 3:
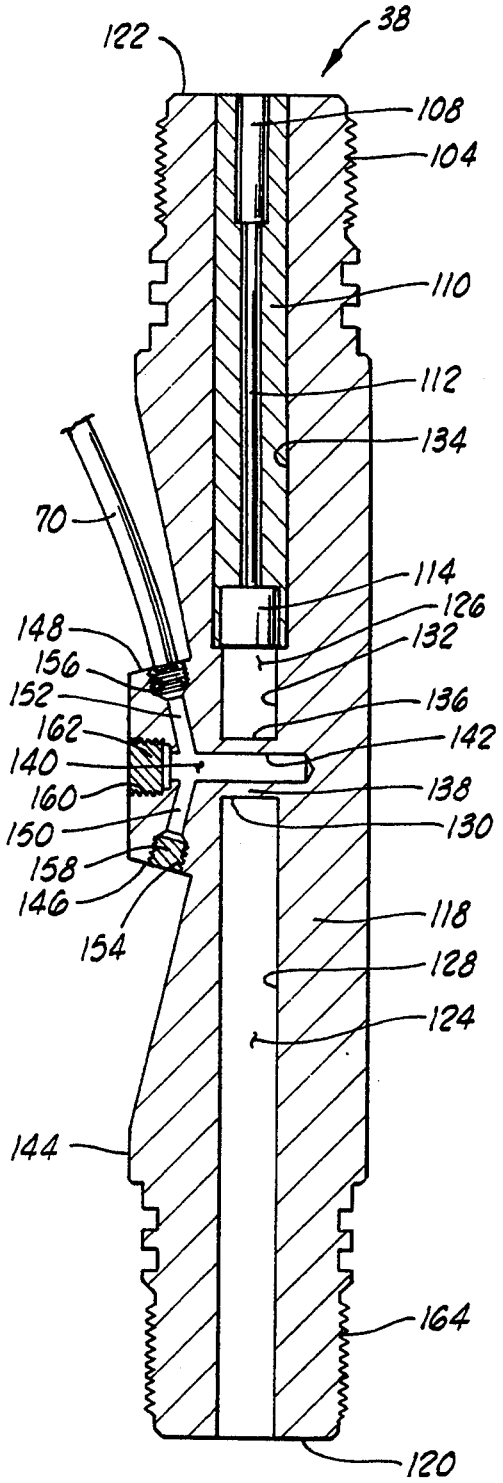
FIG. 3 is an elevation sectioned view showing the details of construction of a select fire sub utilized with the system of FIG. 1.

As is further described below with regard to the detailed drawing of FIG. 3 illustrating the select fire sub 38, the pressure contained in first control fluid conduit portion 70 is initially isolated from the firing heads located therebelow.

The firing heads 32, 44, 56 and 66 preferably are Time Delay Firing Heads available from Vann Systems of Carrollton, Tex. These firing heads employ a time delay fuse. The use of the time delay fuse allows for ample time, on the order of five to seven minutes, to bleed the actuating pressure off the tubing string 26 prior to the time the associated perforating gun fires. The operating pressure of the firing head 32 is determined by selection of the number of shear pins utilized to hold a firing piston in place initially against the differential pressures acting thereacross.

The pressure in tubing string 26 is raised to the actuating pressure necessary to actuate the first firing head 32. When the first firing head 32 is actuated, the pressure in the tubing string 26 is bled off before the firing head 32 actually fires the perforating gun 34. As is further explained below, it is necessary to bleed off the actuating pressure before the first gun 34 fires, or the second firing head 44 would be actuated as soon as the first select fire sub 38 was detonated. After the time delay determined by the construction of the firing head 32, the first firing head 32 fires the first perforating gun 34 which creates a plurality of perforations such as 76 extending through the casing 14 and communicating the casing bore 18 with the first subsurface geological formation 20.

Figure 2:
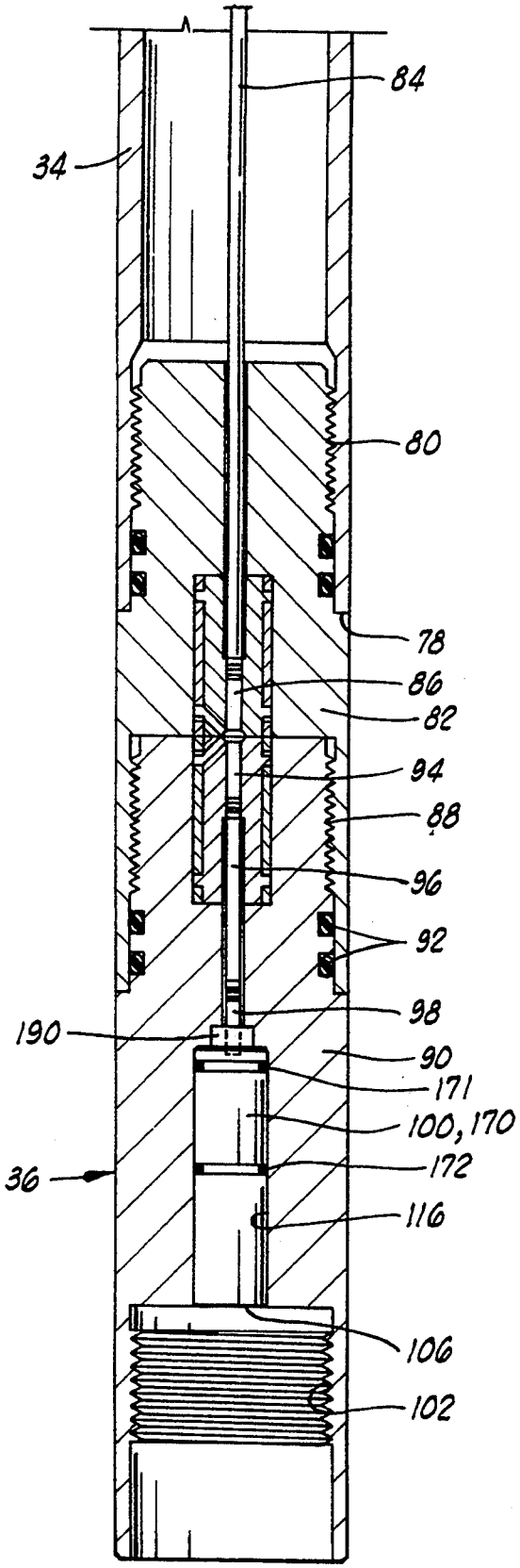
FIG. 2 is an elevation sectioned view showing the details of construction of an isolation sub assembly utilized in the system of FIG. 1. The isolation sub is shown connected to the lower end of a perforating gun.

When the first perforating gun 34 fires, it detonates the first isolation sub 36, the details of construction of which are shown in FIG. 2.

As seen in FIG. 2, a lower end 78 of first perforating gun 34 is threadedly connected at 80 to a crossover sub 82. A detonating cord 84 extends from the lower end of perforating gun 34 through the crossover sub 82 where it terminates in a booster charge 86. The crossover sub 82 and components contained therein may be considered to be a portion of the first perforating gun 34.

The crossover sub 82 is connected at thread 88 to a delay housing 90 of isolation sub 36 with O-ring seals 92 being provided therebetween.

The delay housing 90 carries a booster charge 94 at its upper end which is fired by the booster charge 86. The booster charge 94 in turn ignites a length of detonating cord 96 which leads to a third booster charge 98 which fires a gun delay/isolation device 100.

The lower end portion of delay housing 90 has internal threads 102 which are joined to external threads 104 of the select fire sub 38 seen in FIG. 3, so that a lower end 106 of gun delay/isolation device 100 abuts a booster charge 108 received in the first select fire sub 38. The booster 108 is contained in a cylindrical insert 110 which carries the booster 108, a length of detonating cord 112, and a shaped charge 114.

The gun delay/isolation device 100 when fired by the booster 98 will in turn fire the booster 108, but at the same time will prevent fluid communication through a bore 116 of delay housing 90 thereby maintaining the first perforating gun 34 isolated from the select fire sub 38. The gun delay/isolation device 100 works in the following manner.

FIG. 9 is an enlarged sectioned view of the gun delay/isolation device 100. Device 100 includes a housing 170 received in bore 116 with O-ring seals 171 and 172 received therebetween. Housing 170 has a bore 173, lower counterbore 174, upper counterbore 175, and upper threaded counterbore 176 defining a central passage therethrough.

Upper counterbore 175 has an annular spacer 177 received therein abutting shoulder 178. Located above spacer 177 is a primer cap 179.

Located above primer cap 179 is a piston sleeve 180 carrying O-rings 181 and 182 which seal against counterbore 175. Piston sleeve 180 is threaded at 183 adjacent its upper end 184. Thread 183 is received in threaded counterbore 176 to hold piston sleeve 180 in place.

A piston 185 is received in a bore 186 of piston sleeve 180 with two O-rings 187 and 188 therebetween. Piston 185 has a radially outward extending flange 189 at its upper end which is larger in diameter than bore 186 and initially holds piston 185 in the position shown.

An annular retainer ring 190 is threadedly received in threaded counterbore 176 above piston 185 to prevent upward movement of piston 185.

Retainer ring 190 has booster 98 (see FIG. 2) received in a bore 191 thereof.

Below primer cap 179 the bore of spacer 177 and the bore 173 and counterbore 174 of housing 170 are packed with an explosive mixture 192 which is held in place by a thin retainer disc 193 received in the lower end of lower counterbore 174.

When booster 98 detonates, the high pressure generated thereby pushes down on piston 185 shearing the radial flange 189. Piston 185 travels downward within bore 186 a short distance until firing pin 194 of piston 185 strikes primer cap 179 detonating the same. The detonation of primer cap 179 detonates the explosive material 192 which will rupture disc 193 and in turn detonate booster 108 (see FIG. 3). The burning of explosive mixture 192 will also provide a short time delay in this explosive chain reaction.

The piston 185 remains sealed in bore 186 of piston sleeve 180, thereby preventing any fluid pressure communication through the device 100.

The device 100 is itself a part of the prior art and is constructed in accordance with the teachings of U.S. Pat. No. 5,078,210 to George, the details of which are incorporated herein by reference.

The select fire sub 38 is shown in detail in FIG. 3. Select fire sub 38 includes a cylindrical housing 118 which can be described as having first and second ends 120 and 122 which may also be referred to as lower and upper ends 120 and 122 in the orientation shown in FIG. 3. As will become apparent when viewing the various alternative systems shown in FIGS. 4–8, the orientation of the select fire sub may be inverted.

The housing 118 of select fire sub 38 has first and second axially extending chambers 124 and 126 defined therein and communicated with the first and second ends 120 and 122, respectively, of housing 118. The first chamber 124 is defined by a bore 128 which has a blind end 130. The second chamber 126 is defined by a bore 132 and a counterbore 134. The bore 132 has a blind end 136.

The blind ends 130 and 136 of chambers 124 and 126 are separated by a wall 138 of housing 118.

The housing 118 has an actuating pressure supply passage 140 defined therein. Supply passage 140 includes a lateral bore 142 extending laterally into the wall 138 between the blind ends 130 and 136 of first and second chambers 124 and 126.

Housing 118 includes a cylindrical outer surface 144 having first and second recesses 146 and 148 defined therein on opposite sides longitudinally of the lateral bore 142.

The actuating pressure supply passage 140 further includes first and second branch passages 150 and 152 communicating the lateral bore 142 with the first and second recesses 146 and 148, respectively. Each of the branch passages 150 and 152 includes an internally threaded outermost portion such as 154 and 156 which provides a means for connection thereof to a control fluid conduit such as control fluid conduit portion 70 which extends into the first recess 148.

It is noted that for the first select fire sub 38 of FIG. 1 which is shown in detail in FIG. 3, the threaded outer end 154 of first branch passage 150 is blocked by a threaded plug 158. Also, a threaded outer portion 160 of lateral bore 142 is blocked by a threaded plug 162.

The lower portion of select fire sub 38 carries external threads 164 which are connected to the first air chamber 40 seen in FIG. 1.

As previously described, when the first perforating gun 34 fires, it in turn detonates the first gun delay/isolation device 100 which in turn detonates the first select fire sub 38 by detonating booster 108 which ignites detonating cord 112 which then fires the shaped charge 114. The shaped charge 114 creates a downwardly directed explosive jet which will perforate the wall 138 thus communicating the first and second chambers 124 and 126 with each other and with the lateral bore 142 of actuating pressure supply passage 140. Thus, when the shaped charge 114 perforates wall 138, it communicates the first chamber 124 with the actuating pressure supply passage 140 and thus with the source of actuating fluid pressure contained in the tubing string 26.

This pressure is communicated down through the first chamber 124 and through the first air chamber 40 to the first control line sub 42 seen in FIG. 1. First control line sub 42 communicates the pressure both to the second control fluid conduit portion 72 and to the second pressure actuated firing head 44.

The system 24 is now ready for firing of the second perforating gun 46 when the actuating pressure in tubing string 26 is next raised to a sufficient level.

It will be apparent that if the actuating fluid pressure were not bled off prior to firing of first gun 34, the second firing head 44 would be immediately actuated upon detonation of the first select fire sub 38.

The select fire sub 38 can generally be described as a selective communication means 38 for isolating the second firing head 44 from the source of actuating fluid pressure in tubing string 26 until after the first perforating gun 34 has been fired. After the first perforating gun 34 has been fired, the select fire sub 38 which has in turn been detonated by first perforating gun 34, provides a means for communicating the second firing head 44 with the source of actuating fluid pressure in tubing string 26 in response to the firing of the first perforating gun 34.

The shaped charge 114 can be generally described as an explosive means 114 for perforating a portion of the housing 118, namely the wall 138, and thereby communicating the supply passage 140 with the first chamber 124.

The explosive train contained in the isolation sub 36, namely the detonating cord 84, boosters 86 and 94, detonating cord 96, booster 98 and the gun delay/isolation device 100 can be generally described as an actuating means for firing the shaped charge 114 of select fire sub 38 in response to firing of the first perforating gun 34. The gun delay/isolation device 100 can also be described as an isolation means 100 for isolating the first perforating gun 34 from the first chamber 124 of the select fire sub 38 after the shaped charge 114 of select fire sub 38 is fired thus perforating the wall 138.

The various passages throughout the tool string shown in FIG. 1 which communicate the various tools with the source of actuating fluid pressure in tubing string 26, such as the control fluid conduit portion 70, 72 and 74 may each be considered to be a part of the source of actuating fluid pressure.

Typically it will be desired to move the perforating string 24 before firing the second gun 72. For example, in the situation illustrated in FIG. 1, after the first perforating gun 34 has been fired to perforate the first zone 20, the tubing string 26 will be lowered until the second perforating gun 46 is adjacent the second zone 22 which is to be perforated. The source of actuating fluid pressure in tubing string 26 is now in communication with the second pressure actuated firing head 44.

After the second perforating gun 46 has been located adjacent the second subsurface formation 22, the pressure in tubing string 26 is again raised to an appropriate level to actuate the second firing head 44. Then pressure is bled off prior to the time that the second firing head 44 actually fires the second perforating gun 46.

It is noted that with the system of the present invention, each of the firing heads can be actuated at the same pressure. This is contrasted to prior art systems wherein each successive firing head had to be actuated at a higher pressure. Thus the system of the present invention can be operated at lower actuating pressures than those required by prior art systems.

When the second perforating gun 46 fires, the process described above repeats, that is the second perforating gun will detonate the second isolation device 48 which in turn will detonate the second select fire sub 50 which in turn will place the tubing string 26 in communication with the third firing head 56 and the third control fluid conduit portion 74.

The next time tubing pressure is raised to an appropriate level, the third firing head 56 will be actuated which will in turn fire third perforating gun 58 which will in turn fire third isolation device 60 which will detonate the third select fire sub 62 thus placing the system in condition for subsequent firing of the fourth perforating gun 68 as desired.

When it is desired to fire the fourth perforating gun 68, actuating pressure is again applied to the tubing string 26 and communicated through third control fluid conduit portion 74, third select fire sub 62, and third air chamber 64 to the fourth pressure actuating firing head 66 which will in turn fire the fourth perforating gun 68.

It will be appreciated that any number of perforating guns can be selectively fired with the system described herein by providing additional isolation subs and select fire subs and other related components as required.

It will be apparent that in general the system 24 will have one less select fire sub than it has perforating guns. For example, the system of FIG. 1 has four perforating guns and has three select fire subs. The system can be generally described as having a total number X of perforating guns and having a total number X-1 of select fire subs.

As is apparent from the description just given for the system of FIG. 1, in that system, the first perforating gun 34 is located above the second perforating gun 46 so that the system 24 fires the perforating gun sequentially from the top down.

Figure 4:
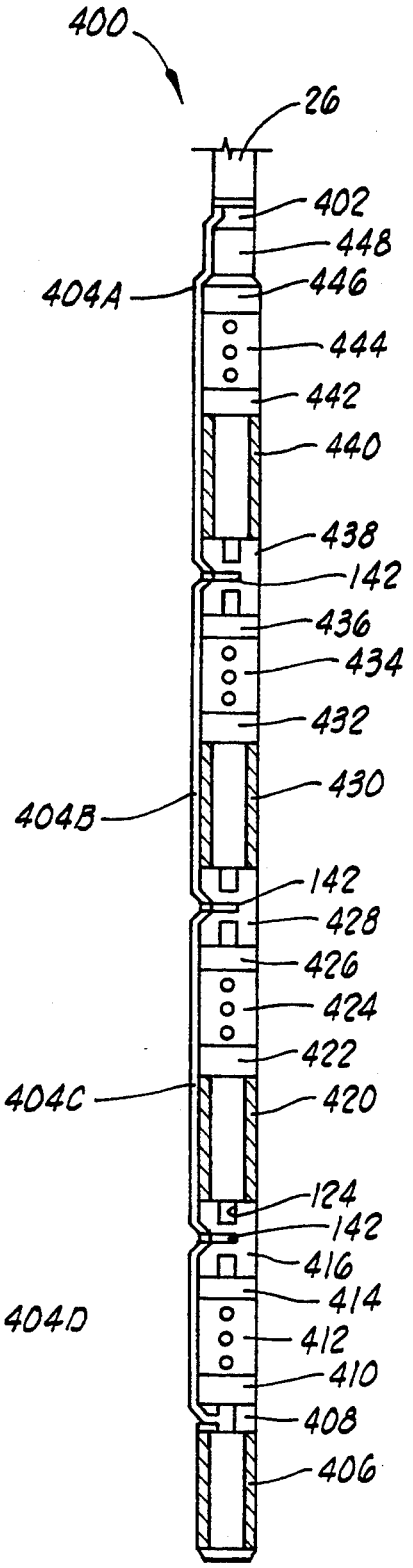
FIG. 4 is an elevation schematic view similar to FIG. 1, but eliminating the details of the surrounding well structure, showing a second version of the tubing conveyed selective fired perforating system of the present invention. The system of FIG. 4 is constructed to operate without a packer, and to selectively fire the plurality of perforating guns in sequence from the bottom up. The system of FIG. 4 is constructed to be actuated by fluid pressure conveyed down the tubing bore and then communicated to the series of select fire subs through control fluid conduits located externally of the subs.

The Alternative Embodiment of FIG. 4

FIG. 4 illustrates an alternative version of the perforating system of the present invention which is shown and generally designated by the numeral 400. The system 400 of FIG. 4 is very similar to the system 24 of FIG. 10, but the components have been somewhat rearranged so that the perforating guns of the perforating string 400 in FIG. 4 fire from bottom up rather than from the top down. The perforating string 400 of FIG. 4, like the system 24 of FIG. 1, is designed for use without a packer and it utilizes the tubing string 26 as a source of actuating fluid pressure.

For ease of illustration in FIGS. 4 and the following figures, the various components of the well surrounding the perforating string have been eliminated. It will be understood that these alternative versions of the perforating string of the present invention are utilized in the same general context as illustrated in FIG. 1.

In FIG. 4, the perforating system 400 includes the tubing string 26 previously mentioned, and a control line sub 402 connected to the tubing string 26. The control line sub 402 provides for connection of a control fluid conduit 404 made up of conduit portions 404A, 404B, 404C and 404D to the inner bore of tubing string 26. As seen in FIG. 4, the control fluid conduit 404 extends alongside the entire string of perforating guns and related devices.

Since the system 400 fires from bottom up, the various components making up that perforating string will be described beginning at the bottom with a first air chamber or fluid chamber 406. Located above first air chamber 406 is a lower control line sub 408 to which the lower end of control fluid conduit 404 is connected.

Lower control line sub 408 provides actuating fluid pressure to a first pressure actuated firing head 410 which after an appropriate time delay will fire a first perforating gun 412.

Located above first perforating gun 412 is a first isolation sub 414 and a first select fire sub 416. The first isolation sub 414 is constructed in a manner similar to the isolation sub 36 of FIG. 2 except that it is inverted as compared to the drawing of FIG. 2.

First select fire sub 416 is similar to the first select fire sub 38 of FIG. 3 with two modifications. The first change is that the first select fire sub 416 is inverted, that is turned upside down relative to the drawing of FIG. 3 so that the shaped charge 114 will be contained in the lowermost chamber of the first select fire sub 416 and will be directed upwardly to perforate the wall 138. The second change is in the manner in which the control fluid conduit 404 is connected to the first select fire sub 416. The control fluid conduit portions 404C and 404D are connected to threaded ends 154 and 156 of branch passages 150 and 152. Plug 162 is still in place in lateral bore 142.

Thus, when it is desired to fire the first perforating gun 412, actuating fluid pressure in tubing string 26 will be increased and communicated through control fluid conduit 404 and through the lower control line sub 408 to first firing head 410 to actuate the same. Actuating fluid pressure will then be bled off during the time delay provided by firing head 410. When the first perforating gun 412 fires, it will detonate the isolation sub 414 which will in turn detonate the first select fire sub 416 thus perforating the wall 138 of first select fire sub 416 and placing the lateral bore 142 of first select fire sub 416 in communication with its upper chamber 124. The perforating string 400 will now be in condition for the firing of the next perforating gun.

The remaining components of first perforating string 400 include a second air chamber 420, a second pressure actuated firing head 422, a second perforating gun 424, a second isolation sub 426, a second select fire sub 428, a third air chamber 430, a third pressure actuated firing head 432, a third perforating gun 434, a third isolation sub 436, a third select fire sub 438, a fourth air chamber 440, a fourth pressure actuated firing head 442, and a fourth perforating gun 444. Located above the fourth perforating gun 444 is a gun-tubing crossover sub 446 and above that is a spacer sub 448 which is connected to the upper control line sub 402.

The second and third select fire subs 428 and 438 have their branch passages 150 and 152 communicated with control fluid conduit portions 404 like described above for sub 416.

When actuating pressure is applied to tubing string 26, a second time to fire the second perforating gun 424, the first isolation device 414 prevents that fluid pressure from entering the already fired first perforating gun 412. The actuating pressure will be bled off. The second gun 424 will fire thus detonating the second isolation sub 426 and second select fire sub 428. The system is then ready for firing of the third gun, 434, and so on.

Thus, the system 400 provides a system which selectively fires a plurality of perforating guns sequentially from the bottom up.

Figure 5:
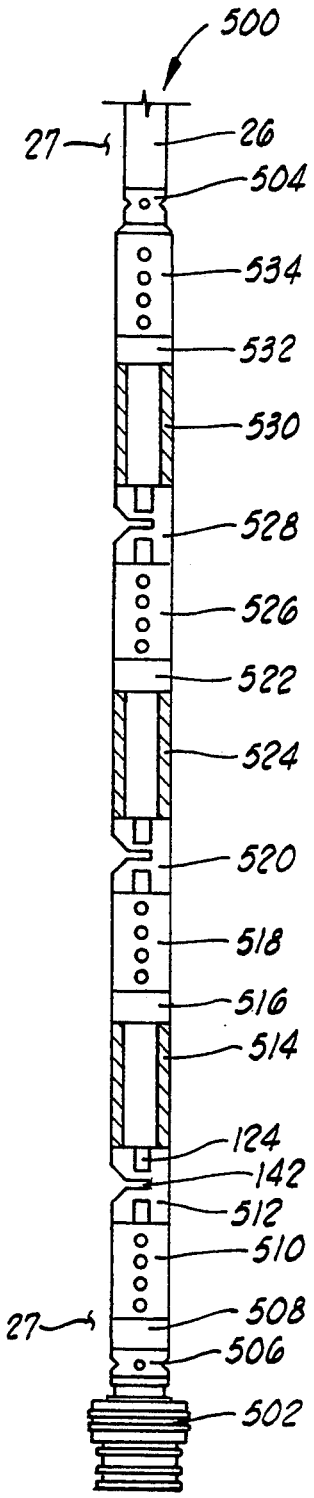
FIG. 5 is a schematic elevation view of a third version of the tubing conveyed selective fired perforating system of the present invention. The plurality of perforating guns are arranged to be selectively fired in sequence from the bottom up. A bridge plug is carried on the lower end of the tool string. The system of FIG. 5 is arranged to be actuated by fluid pressure from the tubing string which is communicated with the well annulus surrounding the perforating guns and select fire subs.

The Embodiment of FIG. 5

Figure 6:
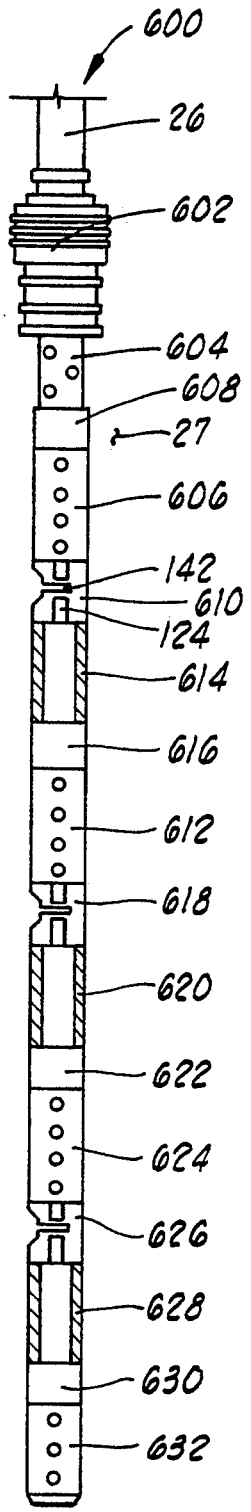
FIG. 6 is an elevation schematic view of a fourth version of the tubing conveyed selective fired perforating system of the present invention. The system of FIG. 6 is constructed to be actuated with tubing pressure which is communicated to a well annulus surrounding the perforating guns and select fire subs. The system of FIG. 6 carries a packer, and the series of guns are fired from the top down.

FIG. 5 shows another version of the perforating string of the present invention which is shown and generally designated by the numeral 500. The system 500 again includes the tubing string 26 which has a plurality of perforating guns and related equipment carried thereon. The system 500 of FIG. 6 is designed to utilize a retrievable bridge 502 on the bottom thereof.

The system 500 is also modified in that although it uses the tubing string 26 as a source of actuating fluid pressure, that pressure is communicated to the various select fire subs through the well annulus 27 (see FIG. 1) which surrounds those select fire subs. This is accomplished with a perforated sub 504 connected to the lower end of tubing string 26 and communicating the bore of tubing string 26 with the surrounding well annulus 27. The perforating string 500 of FIG. 5 is designed to fire its various perforating guns from the bottom up, and thus will be described beginning from the bottom with the retrievable bridge plug 502. Located above the retrievable bridge plug 502 is a lower perforated sub 506 which communicates the surrounding well annulus 27 with the first pressure actuated firing head 508.

With reference to the plurality of zones 20 and 22 shown in FIG. 1, the system 500 would be utilized to perforate those zones preferably beginning with the lowermost zone. For example, if it were first desired to perforate the zone 22 of FIG. 1, the perforating string 500 would be lowered into the well 10 until the retrievable bridge plug 502 was located below zone 22 with first gun 510 adjacent zone 22, and then the retrievable bridge plug 502 would be set within the casing bore 18 to seal the same. Then actuating fluid pressure in the tubing string 26 is increased and communicated through upper perforated sub 504 to the well annulus 27 and from the well annulus 27 through lower perforated sub 506 to the first firing head 508 to actuate the same. After an appropriate time delay during which the actuating fluid pressure would be bled down, the first firing head 508 will fire the first perforating gun 510 to perforate the first zone 22.

The first perforating gun 510 will have connected to its upper end a component like the crossover sub 82 seen in FIG. 2 which will of course be inverted relative to FIG. 2. The crossover sub 82 will be connected directly to the threads 104 of the second end 122 of a first select fire sub 512 which is generally constructed like the select fire sub 38 of FIG. 3 except it is inverted. The booster 86 of the crossover sub 82 utilized with perforating gun 510 will be directly adjacent the booster 108 of the first select fire sub 512, so that upon firing of the first perforating gun 110, the first select fire sub 512 will also be detonated so as to communicate its lateral bore 142 with its first chamber 124. The lateral bore 142 of first select fire sub 512 is already in open communication with the well annulus 27 so that when the first select fire sub 512 is detonated, it will place its chamber 124 in fluid communication with the surrounding well annulus 27 and thus through a first air chamber 514 will place the well annulus 27 in communication with a second pressure actuated firing head 516.

It is noted that in the system of FIG. 5, there is no need for the isolation device like isolation device 100 seen in FIG. 2, and thus the isolation sub 36 and all components contained therein have been eliminated.

When it is desired to perforate another zone such as the upper zone 20 of FIG. 1, the retrievable bridge plug 502 will be unset from the casing bore and the perforating string 500 will be raised until the bridge plug 502 is located above the previously perforated zone 22 and until a second perforating gun 518 is located adjacent the upper zone 20 which is to be perforated. Then actuating fluid pressure is again applied down through the tubing string 26 and annulus 27 and then through the first select fire sub 512, and first air chamber 514 to the second firing head 516 to fire the second perforating gun 518. The actuating pressure is bled off prior to firing of second gun 518.

In response to firing of the second firing gun 518, a second select fire sub 520 will be detonated thus placing a third firing head 522 in communication with the well annulus 27 through a second air chamber 524.

The next time actuating fluid pressure is raised to the appropriate level, the third firing head 522 will fire third perforating gun 526.

In response to firing of third perforating gun 526, a third select fire sub 528 will be detonated thus providing fluid communication of the well annulus 27 through a third air chamber 530 with a fourth firing head 532 which in turn can fire a fourth perforating gun 534.

Typically, prior to firing of each successive perforating gun, the perforating string 500 will be moved uphole so as to place the retrievable bridge plug 502 above all of the previously existing perforations.

Thus the system of FIG. 5 provides a perforating string 500 which utilizes a retrievable bridge plug and fires a plurality of perforating guns selectively in sequence from the bottom up.

The Embodiment of FIG. 6

Still another version of the perforating string of the present invention is shown in FIG. 6 and is generally designated by the numeral 600. The perforating string 600 includes the tubing string 26 and carries a retrievable packer 602 on the lower end of tubing string 26. Located below the retrievable packer 602 is a perforated sub 604 which communicates the inner bore of tubing string 26 with the well annulus 27 surrounding the perforating string 600.

The perforating string 600 of FIG. 6 provides a system which can utilize the retrievable packer 602 to fire a plurality of perforating guns sequentially in series from the top down utilizing the retrievable packer 602 to seal below any perforations which have previously been created.

For example, if it is desired to use the perforating system 600 of FIG. 6 to perforate a plurality of zones such as zones 20 and 22 shown in FIG. 1 beginning with the upper zone 20, the perforating string 600 is run into the well 10 and the retrievable packer 602 is set in the casing bore 18 above the upper zone 20 which is to be first perforated. The first perforating gun 606 is located adjacent the first zone 20 which is to be perforated.

Actuating fluid pressure from tubing 26 is communicated through the perforated sub 604 to a first pressure actuated firing head 608 which after an appropriate time delay will fire the first perforating gun 606. The actuating fluid pressure will be bled off prior to the time that the first perforating gun 606 fires.

In response to the firing of the first perforating gun 606, a first select fire sub 610 will be detonated thus placing its lateral bore 142 in communication with its first chamber 124. The lateral bore 142 is also in open fluid communication with the well annulus 27.

The retrievable packer 602 is then unset from casing bore 18, and the perforating string 600 is lowered until the packer 602 is located below the previously created perforations and until a second perforating gun 612 is located adjacent the next zone, such as zone 22, which is to be perforated.

Then actuating fluid pressure is again applied to tubing string 26 and thus through perforated sub 604 to the well annulus 27, then in through the first select fire sub 610 and through a first air chamber 614 to a second firing head 616 which after appropriate time delay will fire the second perforating gun 612. The actuating fluid pressure is bled off during the time delay.

In response to firing of the second perforating gun 612, a second select fire sub 618 will be detonated. Then the next time that actuating fluid pressure is applied to tubing string 26, it is communicated through second select fire sub 618 and through a second air chamber 620 to a third firing head 622. Actuating pressure is then bled off. After an appropriate time delay, the third firing head 622 will fire the third perforating gun 624. In response to firing of the third gun 624, a third select fire sub 626 will be detonated.

Then the next time actuating fluid pressure is applied to tubing string 26, it will be communicated through third select fire sub 626 and a third air chamber 628 to a fourth firing head 630 which after an appropriate time delay will fire the fourth perforating gun 632.

After firing of each of the perforating guns, the perforating string 600 will typically be moved downward within the well bore so as to locate the retrievable packer 602 below those perforations which have previously been formed.

Thus the perforating system 600 provides a system which can utilize a retrievable packer to fire a plurality of perforating guns selectively in sequence from the top down, while isolating each zone to be perforated from those zones which have previously been perforated.

The Embodiment of FIG. 7

FIG. 7 illustrates another embodiment of the perforating system of the present invention which is shown and generally designated by the numeral 700. The system 700 includes the tubing string 26 previously mentioned. The system 700 of FIG. 7 differs from the systems previously described in that a retrievable upper packer 702 and a retrievable bridge plug or lower packer 704 are carried on the upper and lower ends, respectively, of the tool string so that a zone of the well can be completely isolated between the packer 702 and bridge plug 704 so that after the zone is perforated, it may be flow tested.

The system 700 of FIG. 7 is constructed to fire a plurality of perforating guns selectively in sequence from the top down.

The system 700 also differs from those previously described in that the source of actuating fluid pressure is not the interior of the tubing string 26, but instead is an upper well annulus 27A located above the upper packer 702.

An annulus pressure crossover sub 706 is located above packer 702. A perforated sub 708 which may also be described as a flow test sub 708 is located below packer 702. An upper control line sub 710 is located below flow test sub 708.

The annulus pressure crossover sub 706 communicates fluid pressure from upper well annulus 27A through sub inlet 712 and down through an internal conduit 713 extending through packer 702. The internal conduit 713 is communicated with the inner passage of upper control line sub 710. Thus, control fluid pressure from the upper well annulus 27A is communicated with the upper control line sub 710.

The flow test sub 708 has a plurality of perforations or inlets 714 which are communicated with another internal passage through packer 702 with the inner bore of tubing string 26 so that well fluids may be flowed inward through the inlets 714 of flow test sub 708 and up through the bore of tubing string 26 during a flow test.

To perforate and test the well 10 with the perforating string 700, the operation is carried out in generally the following manner.

For example if it is desired to first perforate the upper zone 20, the perforating string 700 is lowered into the well 10 until the retrievable bridge plug 704 is located below first zone 20 and packer 702 is located above first zone 20 with a first perforating gun 716 located adjacent the zone 20 which is to be perforated. The upper packer 702 and retrievable bridge plug 704 are set within the casing bore 18 so as to isolate the zone 20 which is to be perforated.

Then, actuating fluid pressure is applied to the upper well annulus 27A and is communicated by the annulus pressure crossover sub 706 and through internal conduit 712 with upper control line sub 710 which is communicated through first air chamber 718 with a first pressure actuated firing head 720. After actuation of the first firing head 720, actuating fluid pressure is bled off. After an appropriate time delay, the first gun 716 will fire to perforate the casing adjacent the subsurface zone 20 of interest.

After the first perforating gun 716 is fired, the zone 20 can be flow tested under control of a tester valve (not shown) located within the tubing string 26 to allow flow of well fluids from subsurface formation 20 through the perforations created by perforating gun 716 and in through the inlets 714 of flow test sub 708 and then up through the tubing bore of tubing string 26 to the surface.

The upper control line sub 710 is also communicated with a first control fluid conduit portion 722 which has its lower end connected to a first select fire sub 724. The first select fire sub 724 is arranged identically to the select fire sub 38 shown in FIG. 3 with the first control fluid conduit portion 722 being connected to threaded connection 156 of branch passage 152.

In response to firing of the first perforating gun 716, a first isolation sub 726, which is substantially identical to the isolation sub 36 of FIG. 2, is detonated and in turn detonates the first select fire sub 724 to place the first control fluid conduit portion 722 in fluid communication with a second air chamber 728 and a second control line sub 730.

When it is desired to perforate and test another zone of the well such as the lower formation 22, the packer 702 and retrievable bridge plug 704 are unset from casing bore 18 and the perforating string 70 is moved until the second zone 22 is located between packer 702 and bridge plug 704 with a second perforating gun 732 being located adjacent the second zone 22.

Then actuating fluid pressure is again applied to upper well annulus 27A and is communicated through the annulus pressure crossover sub 706, upper control line sub 710, first control fluid conduit portion 722, first select fire sub 724, second air chamber 728, and second control line sub 730 to a second pressure actuated firing head 734 which in turn will fire the second perforating gun 732. Actuating pressure is bled off before gun 732 fires.

After the second perforating gun 732 is fired to perforate the second zone 22, the second zone 22 can be flow tested through the flow test sub 708.

In response to firing of the second perforating gun 732, a second isolation sub 736 is detonated which in turn detonates a second select fire sub 738, which will place a second control fluid conduit portion 740 in fluid communication through a third air chamber 742 with a third firing head 744 which in turn can selectively actuate a third perforating gun 746.

Thus the perforating string 700 of FIG. 7 provides a system which can selectively isolate, perforate and test multiple zones of a well. The perforating guns of the perforating string 700 are arranged so that they are fired selectively in sequence from the top down.

It will be appreciated that by rearrangement of the perforating guns, select fire subs, isolation subs, and air chambers, a system like that of FIG. 7 operating in response to actuating pressure in the upper well annulus 27A could be constructed to fire its perforating guns from the bottom up.

The Embodiment of FIG. 8

FIG. 8 shows another version of the perforating string of the present invention which is generally designated by the numeral 800. The system 800 includes the tubing string 26 previously mentioned.

The perforating string 800 of FIG. 8 carries a retrievable upper packer 802 and a retrievable bridge plug or lower packer 804 on its upper and lower ends as did the system 700 of FIG. 7.

The system 800 is actuated by fluid pressure within the tubing string 26 which is communicated through an inner bore 806 of packer 802 to a perforated sub or flow test sub 808 which communicates the packer bore 806 with the well annulus 27.

The system 800 of FIG. 8 is constructed to fire its plurality of perforating guns selectively in sequence from the bottom up.

A lower perforated sub 810 is connected to the upper end of bridge plug 804 and communicates the well annulus 27 with a first pressure actuated firing head 812. The firing head 812 will, after an appropriate time delay, fire first perforating gun 814.

Located immediately above first perforating gun 814 is a first select fire sub 816 which will be detonated in response to firing of the first gun 814. There is no isolation sub between first gun 814 and first select fire sub 816. The arrangement of the first gun 814 and first select fire sub 816 is similar to that of the first gun 510 and first select fire sub 512 of the system 500 described above with regard to FIG. 5. That is, the first select fire sub 816 is inverted with reference to the arrangement of FIG. 3. Also, the lateral bore 142 of first select fire sub 816 is in open communication with the well annulus 27.

Detonation of the first select fire sub 816 will place the well annulus 27 in communication through a first air chamber 818 with a second pressure actuated firing head 820.

After the first perforating gun 814 is fired to perforate a first zone of the well, the well can be flow tested by flowing well fluids in through the flow test sub 808 and up the bore of tubing string 26.

When it is desired to perforate and test another zone of the well, the packer 802 and bridge plug 804 are unset, and the test string 800 is moved until a second zone of interest is located between the packer 802 and bridge plug 804 with a second perforating gun 822 located adjacent the second zone of interest. Then fluid actuating pressure is again applied to tubing string 26 and communicated through the first select fire sub 816 and first air chamber 818 to the second firing head 820 to actuate the same. After an appropriate time delay during which actuating fluid pressure is bled off, the second perforating gun 822 will fire thus perforating the second zone of interest which can then be flow tested.

In response to firing of the second perforating gun 822, a second select fire sub 824 is detonated to place the well annulus 27 in communication through an air chamber 826 with a third pressure actuated firing head 828 which can in turn fire a third perforating gun 830.

Thus the perforating string 800 provides a system which is actuated in response to tubing pressure and which can isolate, perforate and test selective zones, with the perforating guns being fired selectively in sequence from the bottom up. It will be appreciated that by rearrangement of the perforating guns, select fire subs and air chambers, that a system like that of FIG. 8 operating on tubing fluid pressure 26 could be constructed to fire its guns from the top down.

Figure 10:
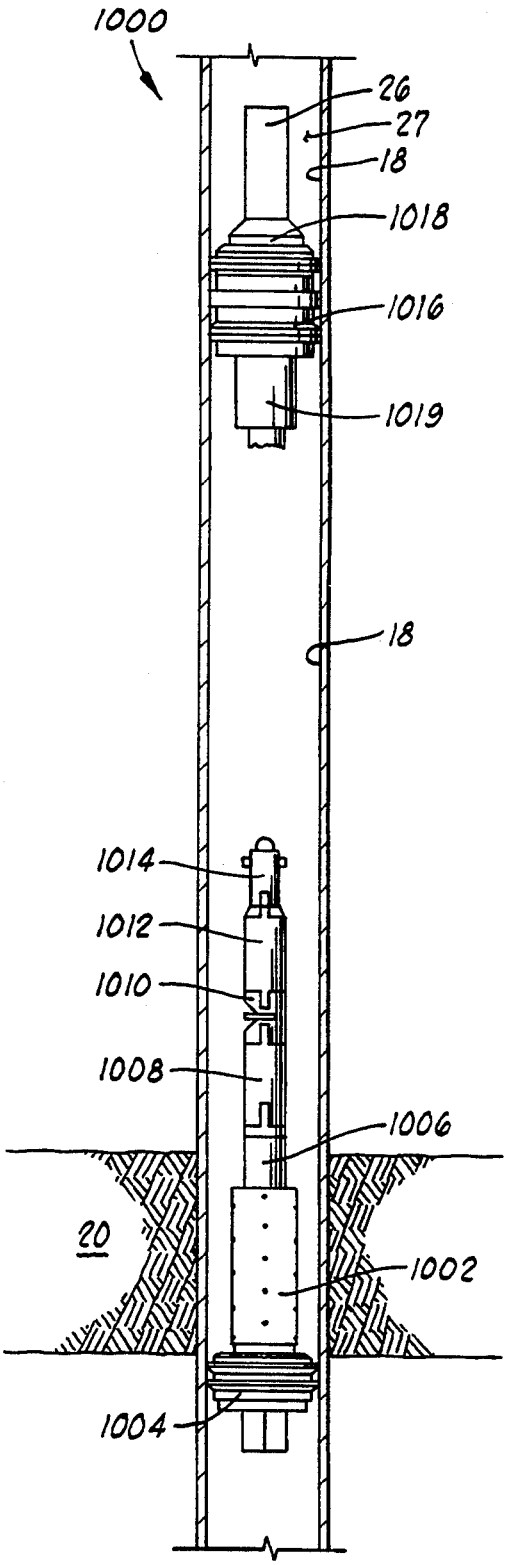
FIG. 10 is an elevation schematic view of a seventh version of the invention wherein a single perforating gun has multiple firing heads associated therewith separated by a select fire sub so as to allow pressure testing or other operation of the well to be performed prior to actuation of the perforating gun.

The Alternative Embodiment of FIG. 10

FIG. 10 illustrates an alternative embodiment of the perforating system of the present invention which is shown and generally designated by the numeral 1000. The system 1000 of FIG. 10 differs from those previously described in that it includes only a single perforating gun which has multiple time delay firing heads associated therewith so that multiple well operations can be performed such as first pressure testing the well and then subsequently perforating the well.

The system 1000 of FIG. 10 includes a perforating gun 1002 supported above an automatic releasing gun hanger 1004 which is set within the casing bore 18. The automatic releasing gun hanger may, for example, be constructed as shown in U.S. patent application Ser. No. 07/930,122 of George et al., filed Aug. 14, 1992, and assigned to the assignee of the present invention, the details of which are incorporated herein by reference.

Located immediately above the perforating gun 1002 is a first pressure actuated time delay firing head 1006, then an air chamber 1008, then a select fire sub 1010, then another pressure actuated time delay firing head 1012, then an on/off tool 1014.

Spaced above the on/off tool 1014 is a packer 1016 carried by the tubing string 26. Located immediately above the packer 1016 is a seal assembly and locator sub 1018. Located below the packer 1016 is a mill-out extension 1019 which initially was connected to the on/off tool 1014.

The system 1000 shown in FIG. 10 is a system of the type sometimes referred to as a monobore completion as is described in more detail in the above-referenced application Ser. No. 07/930,122, the details of which are incorporated herein by reference.

With the system 1000, the on/off tool 1014 and various structures located therebelow are initially supported from the tubing string 26 by the mill-out extension 1019. The tool string is lowered until the auto release gun hanger 1004 is in the position shown in FIG. 10, at which point it is set within the casing bore 18. Then, the mill-out extension 1019 is disconnected from the on/off tool 1014 and the tubing string 26 is raised until the packer 1016 is at the position shown in FIG. 10, at which point the packer 1016 is set within the casing bore 18.

The uppermost time delay firing head 1012 is initially communicated with the casing bore 18. The lowermost time delay firing head 1006 is initially isolated from the casing bore 18 by the select fire sub 1010. The select fire sub 1010 is constructed as shown in FIG. 3 except that the control line 70 is not present and all three ports 156, 160 and 154 are open to the well bore.

After the system is put in the orientation shown in FIG. 10, pressure in the tubing string 26 and thus in the well bore 18 below packer 1016 is increased to a level sufficient to pressure test the well, for example 5000 psi above hydrostatic pressure.

The first time delay firing head 1012 is set to actuate at a pressure level below that at which the well is to be tested, e.g., the firing head 1012 may be set to operate at a pressure of 2000 psi above hydrostatic pressure.

When the pressure in the well is raised to pressure test the well, the first time delay firing head 1012 will be actuated. Prior to the actual firing of the first time delay firing head 1012, the pressure test is completed and pressure within the well is reduced. Subsequently the firing head 1012 will fire thus perforating the wall 138 of select fire sub 1010 and placing the second time delay firing head 1006 in communication with the well bore through the air chamber 1008 and through the passage 140 of select fire sub 1010 after rupturing of the wall 138.

Then the next time well pressure is increased to an appropriate level, e.g., 2000 psi above hydrostatic pressure, it will actuate the time delay firing head 1006 to fire the perforating gun 1002 thus perforating the casing 18 adjacent subsurface formation 20. Once the casing 20 is perforated, the well may be immediately placed in production. Thus, the packer 1016 will serve as a permanent production packer and the tubing string 26 will serve as a production tubing string.

It will be appreciated that if it is desired to conduct more than one pressure test on the well prior to firing of the perforating gun 1002, another select fire sub and another time delay firing head may be placed between firing head 1012 and on/off tool 1014 thus allowing two pressure tests to be conducted.

In general, the system of FIG. 10 may be described as a system for performing multiple operations on a well in response to multiple fluid pressure increases. In the example described, the multiple operations include a first operation of pressure testing the well and a second operation of perforating the well.

Figure 11:
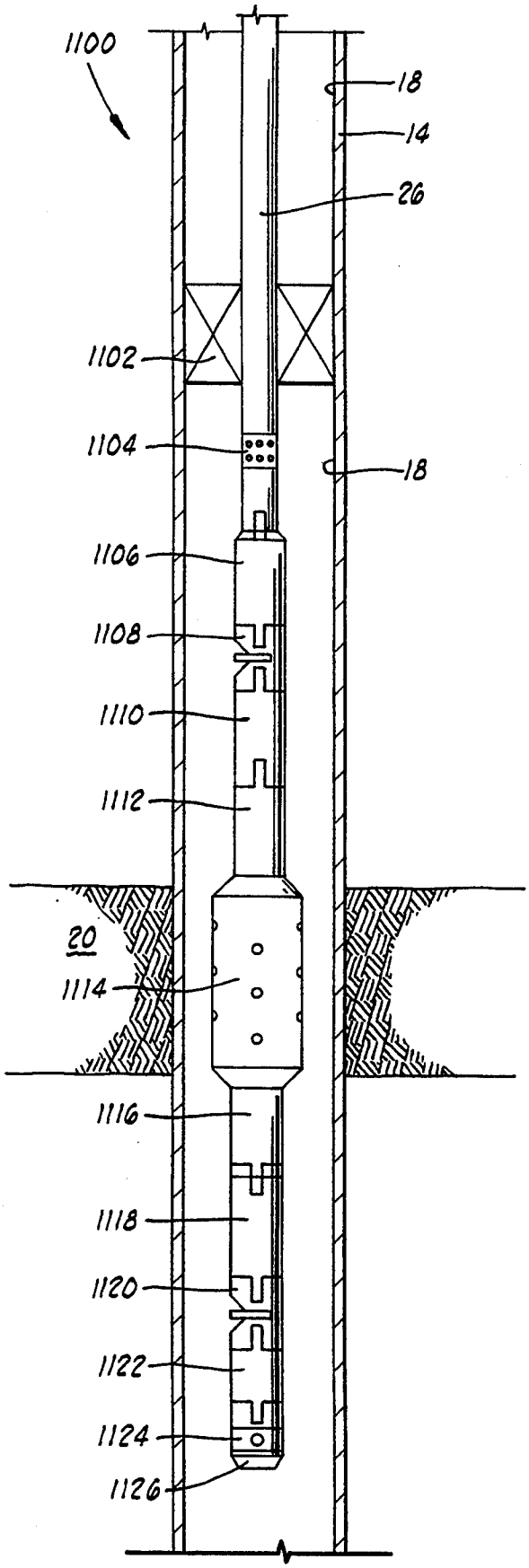
FIG. 11 is an elevation schematic view of an eighth version of the invention which operates in a fashion similar to that of FIG. 10 in that multiple firing heads are associated with a single perforating gun. The embodiment of FIG. 11 provides an optional backup firing head system on the opposite end of the perforating gun from the primary firing head system.

The Alternative Embodiment of FIG. 11

FIG. 11 illustrates an alternative version of the perforating system of the present invention which is shown and generally designated by the numeral 1100. The system 1100 operates in a manner very similar to the system 1000 described with regard to FIG. 10. One difference is that the system 1100 remains attached to the tubing string 26. Another difference is that an optional backup firing head system has been added to the system 1100. Such an optional backup system could also be added to the system 1000 of FIG. 10.

From top to bottom, the system 1100 includes a packer 1102, a perforated nipple 1104, a first pressure actuated time delay firing head 1106, a first select fire sub 1108, an air chamber 1110, a second pressure actuated time delay firing head 1112, a perforating gun 1114, a third time delay firing head 1116, a second air chamber 1118, a second select fire sub 1120, a fourth pressure actuated time delay firing head 1122, a ported nipple 1124, and bull plug 1126.

The packer 1102 may either be a permanent packer or a retrievable packer. The system 1100 is run into the casing 14 until the perforating gun 1114 is located adjacent the subsurface formation 20 which is to be perforated. Then the packer 1102 is set within the casing bore 18.

When it is desired to pressure test the well, fluid pressure is increased down tubing string 26 and communicated to the casing bore 18 below packer 1102 through the perforated nipple 1104. This pressure is also communicated to the firing head 1106, and through ported nipple 1124 to the firing head 1122. Both the firing head 1106 and the firing head 1122 will be fired when the pressure within the well is raised to pressure test the well casing 18 below packer 1102. The pressure applied for pressure testing the well will be released before the firing heads 1106 and 1122 actually fire.

After the built-in time delay has expired, the firing heads 1106 and 1122 will fire thus breaching the walls 1138 of select fire subs 1108 and 1120, respectively. This will place the firing heads 1112 and 1116 in communication with the well bore.

Then the next time fluid pressure is raised to an appropriate level, e.g., 2000 psi above hydrostatic pressure, the firing heads 1112 and 1116 will be actuated and after an appropriate time delay they will fire the perforating gun 1114 to perforate the casing 14 adjacent the subsurface formation 20.

It will be appreciated that the firing heads above the perforating gun 1114 may be considered as a primary firing system and the firing heads below the perforating gun 1114 may be considered as a backup system. Thus if any one of the firing heads fails to operate, the perforating gun 1114 will still be fired at the appropriate time.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the present invention as defined by the appended claims.

What is claimed is:

1. A system for performing multiple operations on a well in response to multiple fluid pressure increases, comprising:

first and second pressure actuated firing heads;

a source of actuating fluid pressure for said firing heads; and a first selective communication means for isolating said second firing head from said source of actuating fluid pressure until after said first firing head has been actuated and for then communicating said second firing head with said source of actuating fluid pressure in response to actuation of said first firing head.

2. The system of claim 1, further comprising:

a total number X of said pressure actuated firing heads including said first and second firing heads; and a total number X-1 of said selective communication means including said first selective communication means.

3. The system of claim 1, wherein:

said first selective communication means includes a select fire sub including:

a housing having a first chamber defined therein communicated with said second firing head;

a supply passage communicated with said source of actuating fluid pressure and extending into said housing, said supply passage initially being isolated from said first chamber; and explosive means for perforating a portion of said housing and thereby communicating said supply passage with said first chamber.

4. The system of claim 3, wherein:

said housing of said select fire sub has a second chamber defined therein in addition to said first chamber, said chambers being initially separated by a wall; and said explosive means is disposed in said second chamber and is a means for perforating said wall.

5. The system of claim 4, wherein:

said supply passage extends into said wall, said wall being said portion of said housing perforated by said explosive means to communicate said supply passage with said first chamber.

6. The system of claim 3, further comprising:

actuating means for firing said explosive means of said select fire sub in response to firing of said first firing head.

7. The system of claim 3, wherein:

said source of actuating fluid pressure includes a well annulus surrounding said select fire sub, said supply passage being open to said well annulus; and said select fire sub is constructed so that when said explosive means perforates said portion of said housing, said first chamber is communicated with said well annulus.

8. A system for pressure testing and perforating a well, comprising:

a perforating gun;

first and second pressure actuated firing heads, said second firing head being operatively associated with said perforating gun for firing said perforating gun, and said first firing head being constructed to actuate at a pressure below a level at which said well is to be tested; and a first selective communication means for isolating said second firing head from said well until after said first firing head has been actuated and for then communicating said second firing head with said well in response to actuation of said first firing head.

9. The system of claim 8, further comprising:

a third pressure actuated firing head constructed to actuate at a pressure below said level at which said well is to be tested; and a second selective communication means for isolating said first firing head from said well until after said third firing head has been actuated and for then communicating said first firing head with said well in response to actuation of said third firing head.

10. The system of claim 8, wherein:

said first selective communication means includes a select fire sub including:

a housing having a first chamber defined therein communicated with said second firing head;

a supply passage communicated with said well and extending into said housing, said supply passage initially being isolated from said first chamber; and explosive means for perforating a portion of said housing and thereby communicating said supply passage with said first chamber.

11. The system of claim 10, wherein:

said housing of said select fire sub has a second chamber defined therein in addition to said first chamber, said chambers being initially separated by a wall; and said explosive means is disposed in said second chamber and is a means for perforating said wall.

12. The system of claim 11, wherein:

said supply passage extends into said wall, said wall being said portion of said housing perforated by said explosive means to communicate said supply passage with said first chamber.

13. The system of claim 10, further comprising:

an air chamber located between said select fire sub and said second firing head.

14. A method of performing multiple operations on a well in response to multiple fluid pressure increases, comprising:

(a) applying a first fluid pressure increase to a source of fluid pressure;

(b) performing a first operation on said well in response to said first fluid pressure increase;

(c) applying said first fluid pressure increase to a first pressure actuated firing head and thereby actuating said first firing head;

(d) isolating a second pressure actuated firing head from said first fluid pressure increase during steps (b) and (c);

(e) in response to actuating said first firing head in step (c), communicating said second firing head with said source of fluid pressure;

(f) applying a second fluid pressure increase to said source of fluid pressure;

(g) applying said second fluid pressure increase to said second firing head and thereby actuating said second firing head; and (h) performing a second operation on said well in response to said second fluid pressure increase.

15. The method of claim 14, wherein:

steps (a) and (c) are performed simultaneously.

16. The method of claim 14, wherein:

step (h) is performed in response to said actuating of said second firing head in step (g).

17. The method of claim 14, wherein:

in step (a), said source of fluid pressure is a well bore of said well; and in step (b), said first operation includes pressure testing said well.

18. The method of claim 17, wherein:

in step (h), said second operation includes firing a perforating gun to perforate said well.

19. The method of claim 14, wherein:

step (d) includes isolating said second firing head from said source of fluid pressure with a wall; and step (e) includes detonating an explosive charge to perforate said wall and thereby communicate said second firing head with said source of fluid pressure.

* * * * *